US006374450B1

(12) United States Patent
Aoyama

(10) Patent No.: US 6,374,450 B1
(45) Date of Patent: Apr. 23, 2002

(54) TOOTHBRUSH

(76) Inventor: Yoshihiro Aoyama, 1-3-8, Hiroo, Shibuya-ku, Tokyo (JP)

( * ) Notice: Subject to any disclaimer, the term of this patent is extended or adjusted under 35 U.S.C. 154(b) by 0 days.

(21) Appl. No.: 09/547,766

(22) Filed: Apr. 12, 2000

(30) Foreign Application Priority Data

Apr. 20, 1999 (JP) ..... 11-112913

(51) Int. Cl.[7] ..... A46B 7/04; A46B 9/04

(52) U.S. Cl. ..... 15/167.1; 75/172; 75/176.1; 75/202

(58) Field of Search ..... 15/167.1, 172, 15/176.1, 176.6, 201, 202

(56) References Cited

U.S. PATENT DOCUMENTS 2,496,010 A * 1/1950 Lotters ..... 15/201
4,020,521 A * 5/1977 Valasquez ..... 15/172
4,592,109 A * 6/1986 Borea et al. ..... 15/172
5,033,154 A * 7/1991 Marchand et al. ..... 15/167.1
5,427,120 A * 6/1995 Wong ..... 15/202 X

FOREIGN PATENT DOCUMENTS

FR 624149 * 7/1927 ..... 15/201
GB 943590 * 12/1963 ..... 15/176.6

* cited by examiner

*Primary Examiner*—Mark Spisich
(74) *Attorney, Agent, or Firm*—Rader, Fishman & Grauer

(57) ABSTRACT

A toothbrush which can be adjusted suitably depending on the detentition and the like of a user for individual use, the toothbrush consisting essentially of a grip handle and a head attached to a distal end of the handle, the head having a multiplicity of bristles implanted on a surface thereof; where the head is an assembly of head segments arranged in a row, each having a through hole defined substantially at the center; the handle has at the distal end thereof a support shaft to be inserted to the through holes of the head segments to support them; the support shaft and the through holes together constitute a locking mechanism that locks the head segments at selected angular positions respectively with respect to the support shaft so that orientations of the bristles in the head segments are changed.

2 Claims, 2 Drawing Sheets

TOOTHBRUSH

BACKGROUND OF THE INVENTION

The present invention relates to a toothbrush composed essentially of a grip handle and a head supported at its distal end, particularly to a toothbrush which is designed to be adjustable for individual use depending on the dentition and size of the mouth.

DESCRIPTION OF THE RELATED ART

There are available various types of toothbrushes each composed essentially of a grip handle and a head supported at its distal end, in terms of handle configuration, head size, rigidity of bristles implanted in the head, etc. Users can select optimum ones depending on their use conditions including the size of the mouth and the like, for example, from those whose handles are curved, those having small heads, those in which the rigidity of bristles implanted in the heads is changed locally, etc.

However, since dentition including occlusion varies greatly depending on individual users, it is sometimes difficult to select an applicable toothbrush from the variations described above.

That is, the conventional ready-made toothbrushes are not designed to be applicable to the individual dentition, but users must compromise on their tooth conditions with the ready-made toothbrushes, so that it is extremely unlikely that the ready-made toothbrushes provide the optima for users.

SUMMARY OF THE INVENTION

It is an objective of the present invention to provide a toothbrush which can suitably be adjusted for individual uses depending on the conditions including dentition and the like that vary depending on the individual users, which can clean not only teeth but also oral mucosa, gingivae, tongue and all others in the oral cavity and which can be adjusted depending on the individual use.

In order to overcome the problem described above, the gist of the present invention is a toothbrush consisting essentially of a grip handle and a head formed at the distal end of the handle, the head having a multiplicity of bristles implanted on a surface thereof; wherein the head consists of a plurality of head segments each having a through hole defined substantially at the center; and the head segments are designed to be locked at desired angular positions respectively with respect to the handle such that orientations of the bristles in the head segments can be changed from segment to segment.

The above toothbrush can be embodied according to various constitutions to be described later.

The handle is provided at the distal end with a support shaft which penetrates the head segments to support them thereon. The support shaft is provided with locking means for locking the head segments at predetermined angles respectively with respect to the support shaft. The head segments supported by the support shaft penetrating them are designed to be locked using fixing means such as welding, adhesive, etc.

Other aspects and advantages of the invention will become apparent from the following description, taken in conjunction with the accompanying drawings illustrated by way of examples the principles of the invention.

BRIEF DESCRIPTION OF THE DRAWINGS

The invention together with the objects and advantages thereof, may best be understood by reference to the following description of the presently preferred embodiment together with the accompanying drawings in which.

DETAILED DESCRIPTION OF THE PREFERRED EMBODIMENTS

The present invention will be described by way of a preferred embodiment referring to the attached drawings.

Figure 1:
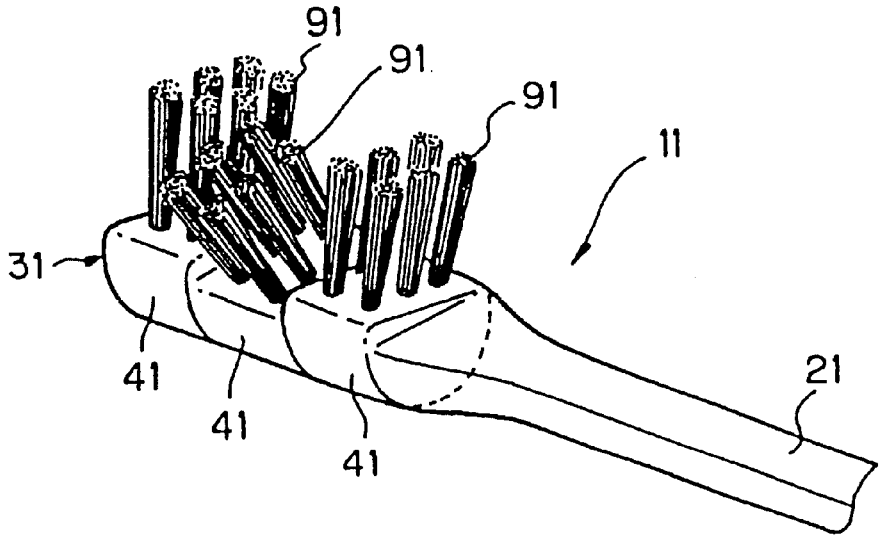
FIG. 1 is a perspective view showing a relevant portion of the toothbrush according to one embodiment of the present invention.

FIG. 1 is a perspective view showing a toothbrush according to one embodiment of the present invention. The toothbrush 11 is composed essentially of a grip handle 21 and a head 31 which is formed at the distal end of the handle 21 and has a multiplicity of bristles 91 implanted thereon. The head 31 is an assembly of a plurality of head segments 41 arranged in a row. The head segments 41 are separate bodies and are designed to be turned by predetermined angles respectively with respect to a support shaft 51 (to be described later) and are locked as such thereon so that orientations of the bristles 91 in the head segments can be changed from segment to segment.

The corners of the head segments 41 and of the handle 21 are rounded not to hurt the mouth during brushing and imparting massaging function to the toothbrush 11.

Figure 2:
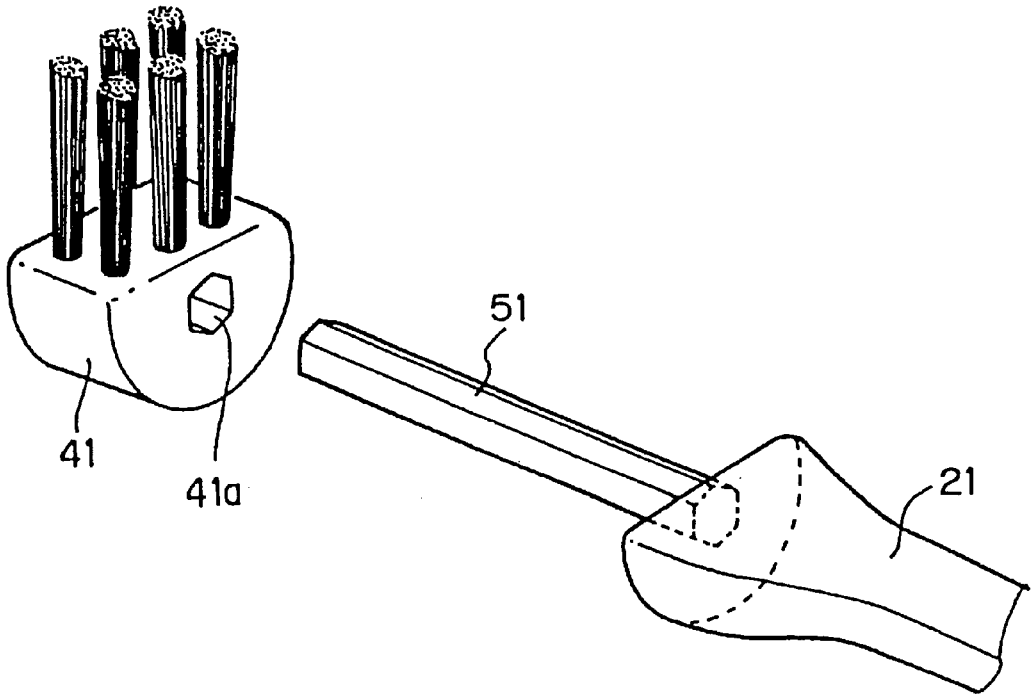
FIG. 2 is an enlarged perspective view showing an explosion of the toothbrush shown in FIG. 1.

FIG. 2 is an enlarged perspective view showing an explosion of the toothbrush shown in FIG. 1.

A support shaft 51 is fixed to the distal end of the handle 21. The support shaft 51 penetrates the head segments 41 to support them thereon. Meanwhile, a through hole 41a having the same profile as that of the support shaft 51 is defined in each head segment 41 substantially at the center, and the support shaft 51 is inserted to the through holes 41*a* to lock the head segments 41 thereon.

Figure 3:
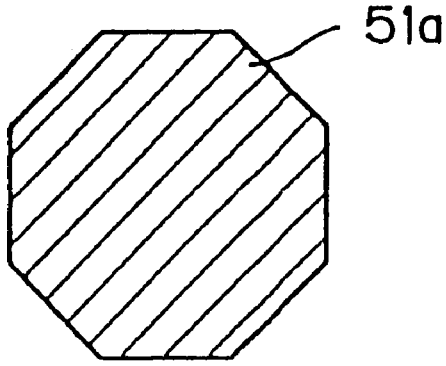
FIGS. 3(A) to 3(C) show in enlarged cross-sectional view other examples of the support shaft.
Figure 3:
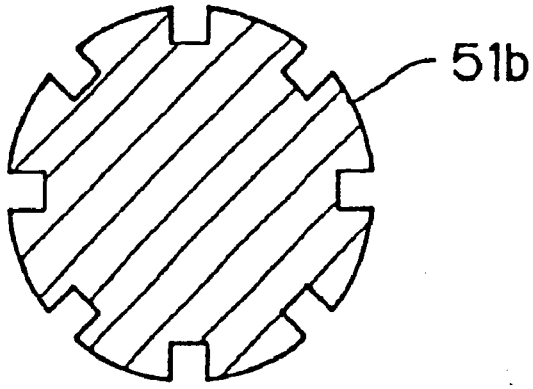
Figure 3:
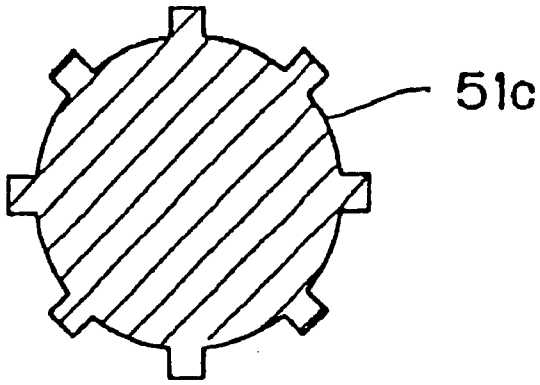

In this case, the support shaft 51 and the through holes 41*a* of the head segments 41 together constitute locking means so as to lock the head segments 41 at desired predetermined angular positions respectively with respect to the support shaft 51. While the support shaft 51 and the through holes 41*a* in this embodiment have a hexagonal profile so as to constitute the locking means, the profile of the former and the latter may not particularly be limited to it. So as to constitute the locking means, for example, the hexagonal profile of the support shaft may be replaced with a regular polygon (see FIG. 3(A)), or grooves or ribs of the same profile may be formed in the longitudinal direction at equiangular positions (see FIGS. 3(B) and 3(C)). Meanwhile, a through hole having a profile capable of receiving the support shaft is defined in each head segment 41.

Formation of the support shaft 51 and the through holes 41*a* with small sectorial angles enables finer angle adjustment in turning the head segments 41. Meanwhile, if the longitudinal dimension of each head segment 41 is reduced or the number of the head segments 41 is increased, more diversified angular combinations can be achieved.

For locking of the head segments 41, there is employed a technique of fixing the support shaft 51 with the head segments 41 and also between the adjacent head segments 41 one another using an adhesive. In addition, the distal end of the support shaft 51 may be subjected to anti-loosening treatment in the absence or presence of an adhesive, for example, caulking, welding and bolting. Further, there may also be employed a technique where a thread is formed at the distal end portion of the support shaft 51, and after insertion of the support shaft 51 to the through holes 41*a* of the head segments 41, the protruding threaded portion is engaged with a nut to fasten them.

In addition to the above constitutions, it is also possible to form a fitting structure capable of selectively positioning the head segments with respect to one another in terms of angle, for example, boss-and-dent engagement surfaces formed on the handle end face and on each end face of each head segment 41, and a round support shaft may be inserted to these head segments 41. Alternatively, a round support shaft may be inserted to head segments which may be fixed thereto using an adhesive to achieve orientation of the bristles in the respective head segments at desired angles.

As described above, in the toothbrush 11 according to this embodiment, the bristles 91 in each head segment 41 can be oriented in a desired direction by turning and locking each head segment 41 at a desired angle taking conditions of a user into consideration. Thus, toothbrushes well adjusted for individual uses respectively can be obtained easily and securely in spite of the simple structure. Further, the uneven side faces of the head segments 41 exhibit effect of massaging gingivae.

The toothbrush according to the present invention brings about the following effects.

Since the bristles implanted in the head segments are designed to be oriented outward or in a desired direction in the above toothbrush, the orientation of the bristles of the brush can be changed locally depending on the dentition of a user, thus providing a toothbrush which has a simple structure and yet can cope with conditions of individual users easily and accurately. In addition, since the rows of bristles assume a configuration matching the tooth surface, a simple brushing motion can prevent effectively tooth and intraoral diseases.

Although only one embodiment of the present invention has been described herein, it should be apparent to those skilled in the art that the present invention may be embodied in many other specific forms without departing from the spirit or scope of the invention.

Therefore, the present examples and embodiments are to be considered as illustrative and not restrictive, and the invention is not to be limited to the details given herein, but may be modified within the scope of the appended claims.

What is claimed is:

1. A toothbrush, comprising:

a grip handle; and a toothbrush head formed at a distal end of the handle, the toothbrush head having a multiplicity of bristles implanted on a surface thereof, wherein the toothbrush head consists of a plurality of toothbrush head segments each having bristles planted thereon with all of said bristles rising substantially unidirectionally therefrom, the handle has at the distal end thereof a support shaft to be inserted into the toothbrush head segments to support them on the support shaft so that orientations of the bristles in one or more brush segments are fixed, and the support shaft constituting a locking mechanism that locks the toothbrush head segments at selected angular positions respectively with respect to the support shaft.

2. A brush, comprising:

a grip handle; and a head formed at a distal end of the handle, the head having a multiplicity of bristles implanted on a surface thereof, wherein the head consists of a plurality of head segments each having bristles planted thereon with all of said bristles rising substantially unidirectionally therefrom, the handle has at the distal end thereof a support shaft to be inserted into the head segments to support them on the support shaft so that orientations of the bristles in one or more head segments are fixed, and the support shaft constituting a locking mechanism that locks the head segments at selected angular positions respectively with respect to the support shaft.

* * * * *